US010289052B2

(12) United States Patent
Eguchi

(10) Patent No.: US 10,289,052 B2
(45) Date of Patent: May 14, 2019

(54) IMAGE FORMING APPARATUS

(71) Applicant: CANON KABUSHIKI KAISHA, Tokyo (JP)

(72) Inventor: Hiroki Eguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/828,131

(22) Filed: Nov. 30, 2017

(65) Prior Publication Data

US 2018/0157204 A1 Jun. 7, 2018

(30) Foreign Application Priority Data

Dec. 6, 2016 (JP) ..... 2016-237117

(51) Int. Cl.

| | |
|---|---|
| ***G03G 15/00*** | (2006.01) |
| ***G03G 15/20*** | (2006.01) |
| *G03G 15/08* | (2006.01) |
| *G03G 21/00* | (2006.01) |
| *G03G 21/16* | (2006.01) |

(52) U.S. Cl.

CPC ..... *G03G 15/6576* (2013.01); *G03G 15/2064* (2013.01); *G03G 15/5029* (2013.01); *G03G 15/6555* (2013.01); *G03G 15/6573* (2013.01); *G03G 15/0887* (2013.01); *G03G 15/2003* (2013.01); *G03G 15/2028* (2013.01); *G03G 21/0011* (2013.01); *G03G 21/1685* (2013.01); *G03G 2215/00662* (2013.01)

(58) Field of Classification Search

CPC ..... G03G 15/2028; G03G 15/5029; G03G 15/6555; G03G 15/6573; G03G 15/6576; G03G 15/2064; G03G 15/0887; G03G 15/2003; G03G 21/0011; G03G 21/1685; G03G 2215/00662

See application file for complete search history.

(56) References Cited

U.S. PATENT DOCUMENTS

| | | | |
|---|---|---|---|
| 2011/0076067 | A1* | 3/2011 | Nagai et al. |
| 2018/0148291 | A1* | 5/2018 | Matsumoto |

FOREIGN PATENT DOCUMENTS

| | | | |
|---|---|---|---|
| JP | 08-12162 | A | 1/1996 |
| JP | 09-188457 | A | 7/1997 |
| JP | 2002-055541 | A | 2/2002 |
| JP | 2003-118882 | A | 4/2003 |

(Continued)

*Primary Examiner* — Joseph S Wong

(74) *Attorney, Agent, or Firm* — Canon U.S.A. Inc., IP Division

(57) ABSTRACT

An image forming apparatus includes an image forming unit, a fixing unit including a tubular film and an opposed member to form a first nip, a conveying unit including a second nip, the pressure variable mechanism changing a pressure of the second nip, a control unit controlling the pressure variable mechanism, and an acquisition unit acquiring information about a length of the recording material. The control unit controls the pressure variable mechanism according to the information so that the recording material is conveyed by the second nip set to a first pressure when the length of the recording material is less than a predetermined length, and the recording material is conveyed by the second nip set to a second pressure lower than the first pressure when the length of the recording material is equal to or greater than the predetermined length.

14 Claims, 11 Drawing Sheets

(56) References Cited

FOREIGN PATENT DOCUMENTS

| | | | |
|---|---|---|---|
| JP | 2008074571 | A | 4/2008 |
| JP | 2011064714 | A | 3/2011 |
| JP | 2014032236 | A | 2/2014 |

* cited by examiner

IMAGE FORMING APPARATUS

BACKGROUND OF THE INVENTION

Field of the Invention

The present disclosure relates to a fixing device mounted on an image forming apparatus using an electrophotographic method or the like.

Description of the Related Art

An image forming apparatus using an electrophotographic method, such as a copying machine or a printer, uses a method in which when a printed material is created, a recording material bearing a toner image passes through a fixing nip portion of a fixing device to apply heat and pressure to the toner image, to fix the toner image onto the recording material. The recording material which has passed through the fixing device in this manner has an inclination to curl (hereinafter referred to as "curling") due to the heat or pressure applied by the fixing nip portion. If the curled recording material is directly discharged onto a discharge tray, the recording material may be curled up on the discharge tray, or may push recording materials stacked on the discharge tray, which affects stacking properties of the recording materials.

Accordingly, a curling correction device (hereinafter referred to as a decurling device) for correcting curling of a recording material is provided downstream of a fixing device in a recording material conveying direction. The decurling device applies a pressure to the curled recording material in a direction opposite to the curling direction of the recording material. Japanese Patent Application Laid-Open No. H08-12162 discusses a decurling device capable of checking the size and direction of curling by passing a recording material through the device once, and adjusting a corrective force according to the direction and size of curling of the recording material.

In recent years, in the case of point of purchase (POP) at a retail shop, a poster, and the like, there has been an increasing demand for printing of a recording material which size is greater in the recording material conveying direction than a normal paper size such as A3 or A4. Such a recording paper greater than the normal size is hereinafter referred to as a continuous sheet. When such a continuous sheet is printed, a skew larger than that when an A3 or A4 sheet is printed may occur. The skew-fed recording material may cause a fixing member to move in a width direction of the recording material and may damage the fixing member.

SUMMARY OF THE INVENTION

A first aspect of the present disclosure is an image forming apparatus including an image forming unit configured to form an image on a recording material, a fixing unit configured to fix the image on the recording material, the fixing unit including a tubular film and an opposed member which is in contact with an outside surface of the film to form a first nip portion together with the film, wherein the recording material having the image formed thereon is heated while being conveyed by the first nip portion, a including a conveying unit configured to convey the recording material having the image fixed thereon by the fixing unit, the conveying unit including a second nip portion configured to convey the recording material, the second nip portion being located at a position where a piece of recording material can be conveyed by the first nip portion and the second nip portion simultaneously, a pressure variable mechanism capable of changing a pressure of the second nip portion, a control unit configured to control the pressure variable mechanism, and an acquisition unit configured to acquire information about a length of the recording material in a conveying direction of the recording material. The control unit controls the pressure variable mechanism according to the information about the length of the recording material acquired by the acquisition unit so that the recording material is conveyed by the second nip portion set to a first pressure in a case where the length of the recording material is less than a predetermined length, and the recording material is conveyed by the second nip portion set to a second pressure lower than the first pressure in a case where the length of the recording material is equal to or greater than the predetermined length.

A second aspect of the present disclosure is an image forming apparatus including an image forming unit configured to form an image on a recording material, a fixing unit configured to fix the image on the recording material, the fixing unit including a tubular film and an opposed member which is in contact with an outside surface of the film to form a first nip portion together with the film, wherein the recording material having the image formed thereon is heated while being conveyed by the first nip portion, and a conveying unit configured to convey the recording material having the image fixed thereon by the fixing unit, the conveying unit including a second nip portion configured to convey the recording material, the second nip portion being located at a position where a piece of recording material can be conveyed by the first nip portion and the second nip portion simultaneously, the pressure variable mechanism being configured to change a pressure of the second nip portion, and a control unit configured to control the pressure variable mechanism. The control unit can execute a first mode in which the control unit controls the pressure variable mechanism in such a manner that a pressure of the second nip portion becomes the first pressure and the second nip portion set to the first pressure conveys the recording material, and a second mode in which the control unit controls the pressure variable mechanism in such a manner that the pressure of the second nip portion becomes the second pressure lower than the first pressure, and the second nip portion set to the second pressure conveys the recording material. The first mode is a mode in which an image is formed on the recording material having a length less than a predetermined length, and the second mode is a mode in which an image is formed on the recording material having a length equal to or greater than the predetermined length.

Further features of the present disclosure will become apparent from the following description of exemplary embodiments with reference to the attached drawings.

DESCRIPTION OF THE EMBODIMENTS

Configuration for carrying out the present disclosure will be described in detail below based on a first exemplary embodiment with reference to the drawings.

<Overall Configuration of Image Forming Apparatus>

Figure 1:
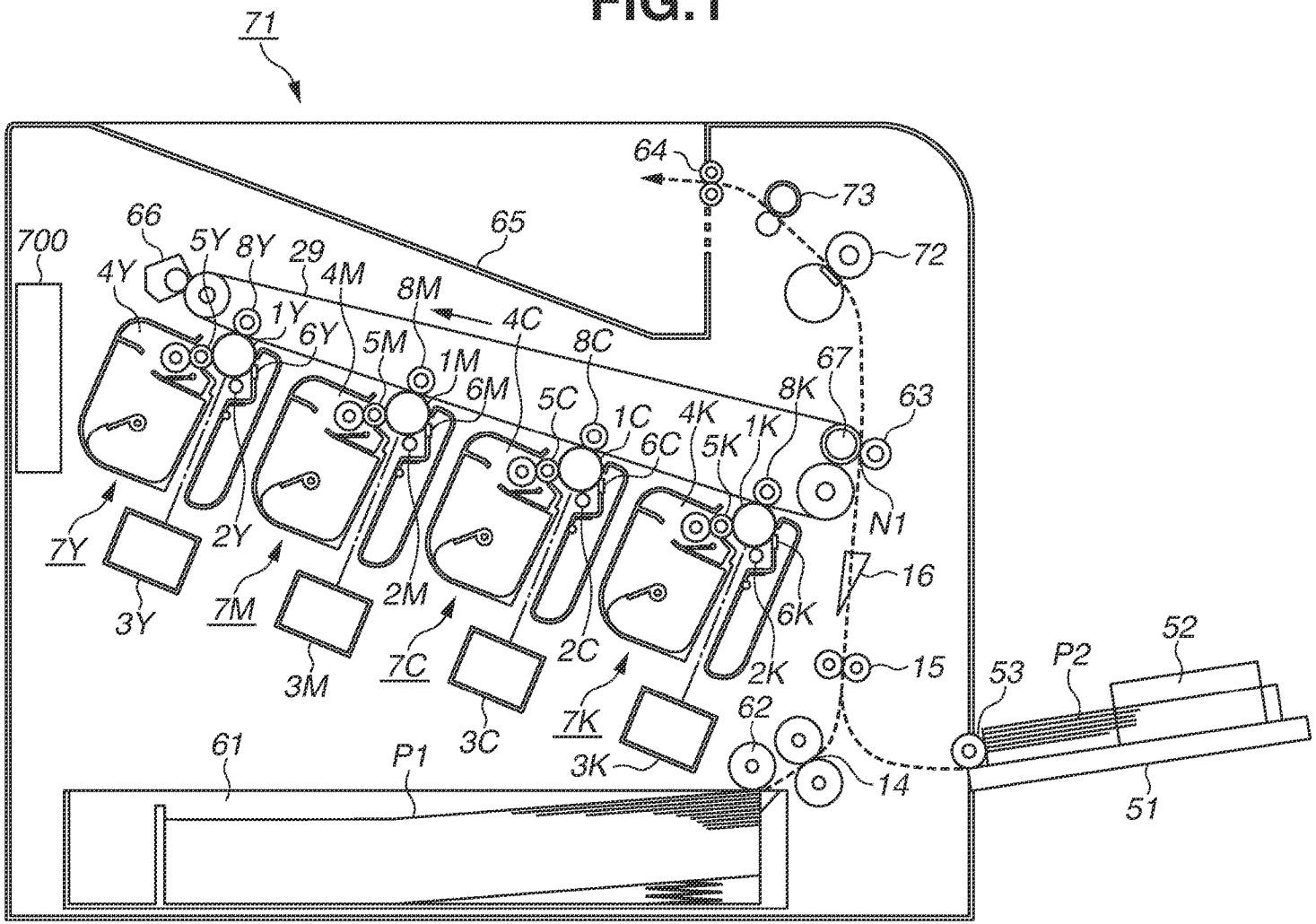
FIG. 1 is a sectional view illustrating an image forming apparatus according to a first exemplary embodiment.

An overall configuration of an image forming apparatus according to the first exemplary embodiment of the present disclosure (hereinafter referred to as the present exemplary embodiment) will now be described with reference to FIG. 1. FIG. 1 is a schematic sectional view illustrating the overall configuration of the image forming apparatus according to the present exemplary embodiment. As an example of the image forming apparatus, a full color laser beam printer (hereinafter referred to simply as a printer) 71 which includes a plurality of photoconductive drums 1 will be described below. However, the present exemplary embodiment is not limited to the full color laser beam printer but may also be a monochromatic copying machine or printer including one photoconductive drum.

As illustrated in FIG. 1, the printer 71 includes, as main components, image forming stations 7Y, 7M, 7C, and 7K corresponding to yellow Y, magenta M, cyan C, and black B, respectively, an intermediate transfer belt 29, a secondary transfer roller 63, a fixing device 72, and a decurling device 73. The image forming stations (7Y to 7K) and the secondary transfer roller 63 are referred to as an image forming unit for forming an image on a recording material. When there is no need to distinguish the elements for the respective colors, suffixes Y, M, C, and K added to the elements to represent the elements for the respective colors are omitted in the following description.

A lower portion of the printer 71 contains a sheet supplying cassette 61 in such a manner that the sheet supplying cassette 61 can be pulled out. Recording materials P1 such as paper, are stacked and accommodated in the sheet supplying cassette 61. The recording materials P1 are fed from the sheet supplying cassette 61 by a pickup roller 62, separated one by one by a feed retard roller pair 14, and fed to registration rollers 15. A multiple sheet supplying plate 51 is installed at a side surface of the printer 71 in such a manner that the plate 51 can be opened or closed, and recording materials P2 such as paper, can be stacked on the plate 51. A side regulating plate 52 regulates the size of a recording material P2 that is able to pass, in a direction (hereinafter referred to as a width direction) orthogonal to a conveying direction, but does not regulate the size of the recording material P2 in the conveying direction. The recording materials P2 are fed one by one from the multiple sheet supplying plate 51 by a multiple sheet supplying roller 53, and are sent to the registration rollers 15. The subsequent processes for the recording materials P1 and the recording materials P2 are the same, and thus only the processes for the recording materials P2 will be described in the present exemplary embodiment.

Each image forming station 7 is provided with the photoconductive drum 1 which is an image bearing member, a charging device 2, a developing device 4, a cleaning blade 6, and a primary transfer portion 8. The charging device 2 uniformly charges the surface of the photoconductive drum 1. The developing device 4 includes a developing roller 5 that forms a toner image by causing a toner to adhere to an electrostatic latent image formed on the photoconductive drum 1. The primary transfer portion 8 primarily transfers the toner image formed on the photoconductive drum 1 onto the intermediate transfer belt 29. The cleaning blade 6 removes a residual toner that has not been primarily transferred and remains on the photoconductive drum 1.

Further, at the lower side of the image forming station 7, laser scanners 3Y, 3M, 3C, and 3K are disposed which form an electrostatic latent image on the corresponding photoconductive drum 1 by irradiating the charged photoconductive drum 1 with a laser beam based on image information. The toner image formed on the intermediate transfer belt 29 and transferred in the primary transfer portion 8 is secondarily transferred onto the recording material P2 by a secondary transfer unit N1 that is composed of an opposed roller 67 and the secondary transfer roller 63. Secondary transfer residual toner that has not been transferred onto the recording material P2 by the secondary transfer unit N1 and remains on the intermediate transfer belt 29 is removed and collected by a belt cleaning device 66. The recording material P2 which has passed through the secondary transfer unit N1 passes through the fixing device 72 and the toner image is fixed onto the recording material P2.

The recording material P2 with the toner image fixed thereon passes through the decurling device 73 to correct curling of the recording material P2 and convey the recording material P2 to a discharge roller pair 64. After passing through the discharge roller pair 64, the recording material P2 is discharged to a recording material stack portion 65. A3-size recording materials can pass through the printer 71 according to the present exemplary embodiment and the recording materials P1 and P2 having a size up to 320 mm in the width direction can pass through the printer 71. The image forming apparatus 71 according to the present exemplary embodiment conveys the recording materials P1 and P2 with a center as a reference.

Figure 2:
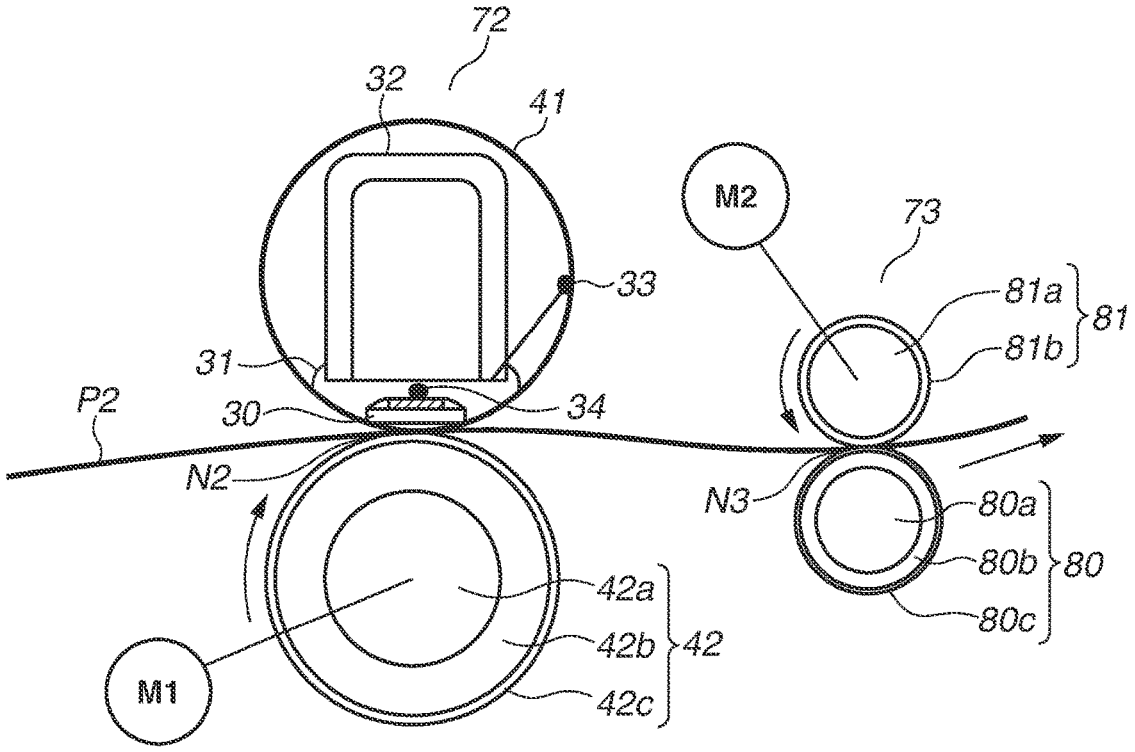
FIG. 2 is a sectional view illustrating a fixing device and a decurling device according to the first exemplary embodiment.
Figure 3:
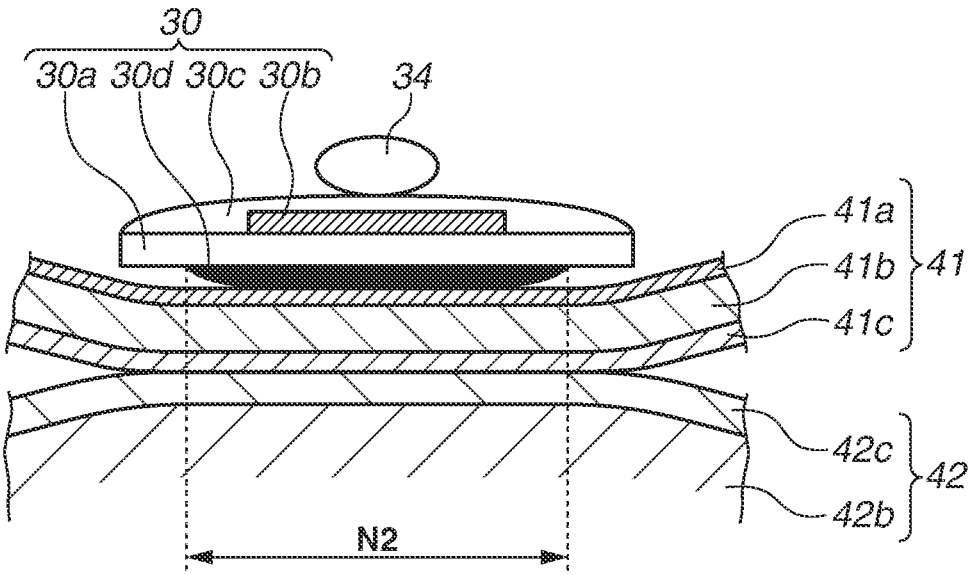
FIG. 3 is an enlarged view illustrating a fixing nip portion according to the first exemplary embodiment.

Next, the configurations of the fixing device 72 and the decurling device 73 will be described in detail with reference to FIGS. 2 and 3. FIG. 2 is a schematic sectional view illustrating the fixing device 72 and the decurling device 73. FIG. 3 is an enlarged sectional view of the fixing device 72 in the vicinity of a nip portion.

(Fixing Device)

The fixing device 72 according to the present exemplary embodiment includes a pair of rotary members that form a fixing nip portion (first nip portion) N2. The pair of rotary members includes a tubular fixing film 41 serving as a fixing member, and a pressure roller 42 serving as a pressure member (opposed member). The fixing device 72 further includes a heater 30 that heats the fixing film 41, and the fixing nip portion N2 is formed by pressing the pressure roller 42 against the heater 30 across the fixing film 41. The fixing device 72 further includes a temperature detection element 33 (hereinafter referred to as a main thermistor) which is in contact with an inside surface of the fixing film 41, and a temperature detection element 34 (hereinafter referred to as a sub-thermistor) which is in contact with the heater 30. The main thermistor 33 is provided in a sheet-passing area for a recording material having a minimum width that can be conveyed by the image forming apparatus. The sub-thermistor 34 is provided outside the sheet-passing area for the recording material having a minimum width and within a sheet-passing area for a recording material having a maximum width that can be conveyed by the image forming apparatus.

The fixing film 41 is formed of an elastic layer 41*b* on an outer periphery of a base layer 41*a*, which takes an endless shape, and a mold release layer 41*c* on an outer periphery of the elastic layer 41*b*. The fixing film 41 takes a cylindrical shape with an outside diameter of 24 mm.

A resin-based material such as polyimide, or a metallic material such as SUS, is used for the base layer 41*a*. In the present exemplary embodiment, a SUS film is used which is formed in an endless shape and has a thickness of 30 μm determined in consideration of its strength.

It is preferable to use a material having a high thermal conductivity as much as possible for the elastic layer 41*b* in terms of quick start. Accordingly, in the present exemplary embodiment, silicone rubber having a thermal conductivity of about $1.0\times10^{-3}$ cal/sec·cm·K and having a thickness of about 270 μm is used for the elastic layer 41*b*.

The mold release layer 41*c* is provided to prevent a toner offset phenomenon. The phenomenon is caused when toner temporarily adheres to the surface of the fixing film and moves to the recording material P2 again. As a material for the mold release layer 41*c*, fluororesin such as PTFE or PFA, silicone resin, or the like is used. In the present exemplary embodiment, a PFA tube having a thickness of about 20 μm is used as the mold release layer 41*c*, and the PFA tube is coated on an outer peripheral surface of the silicone rubber serving as the elastic layer 41*b*.

The heater 30 includes a substrate 30*a* which is elongated in the longitudinal direction. The substrate 30*a* is an insulating substrate which is formed of ceramics such as aluminum nitride or alumina and has excellent thermal conductivity. In the present exemplary embodiment, aluminum nitride that is formed into a rectangular shape having a thickness of 0.6 mm, a width of 9 mm, and a longitudinal size of 390 mm is used as the substrate 30*a* in consideration of both heat capacity and strength.

A heating resistor layer 30*b* serving as a heat generator is formed along the longitudinal direction of the substrate 30*a* on a back surface of the substrate 30*a*. The heating resistor layer 30*b* contains an AgPd alloy, an NiSn alloy, a $RuO_2$ alloy, and the like as main components, and is molded to have a thickness of about 10 μm, a length of 310 mm, and a width of 5 mm. The heating resistor layer 30*b* generates heat when a current is supplied from a power source (not illustrated) through both end portions.

The insulating glass layer 30*c* ensures insulation from an external conductive member by overcoating the heating resistor layer 30*b*. In addition, the insulating glass layer 30*c* has a corrosion-resistant function which prevents a change in resistance value due to oxidation or the like of the heating resistor layer 30*b*. Further, the insulating glass layer 30*c* serves to prevent mechanical damages. The insulating glass layer 30*c* has a thickness of 80 μm.

A sliding layer 30*d* is a layer which has a thickness of 6 μm, containing an imide-based resin such as polyimide or polyamide-imide as a component. The sliding layer 30*d* is provided on a surface of the substrate 30*a* and slides against an inner peripheral surface of the fixing film 41. The sliding layer 30*d* performs an excellent function in heat resistance, lubricity, and abrasion resistance, and shows a smooth sliding property relative to the inner peripheral surface of the fixing film 41.

The pressure roller 42 includes a core portion 42*a*, at least one heat-resistant elastic layer 42*b* provided on the outer peripheral surface of the core portion 42*a*, and a release layer 42*c* provided on the outer peripheral surface of the heat-resistant elastic layer 42*b*. For example, a typical heat-resistant rubber elastic material, such as silicone rubber or fluororubber, can be used for the heat-resistant elastic layer 42*b*. The release layer 42*c* is formed by coating any one of fluororesin materials such as PFA, PTFE, and FEP, or a combination thereof, on the heat-resistant elastic layer 42*b*, or by coating a tube formed using any one of the above-described fluororesin materials, or a combination thereof, on the heat-resistant elastic layer 42*b*. In the present exemplary embodiment, a core metal having a diameter of 17.5 mm and made of iron is used as the core portion 42*a*, and silicone rubber having a thickness of 4.45 mm is used as the heat-resistant elastic layer 42*b*. A PFA tube of 50 μm is coated as the release layer 42*c*.

Next, control of the heater 30 will be described with reference to FIG. 11. A control unit 700 of the image forming apparatus controls power to be supplied to the heater 30 so that a temperature detected by the main thermistor 33 reaches a target temperature. Usage of the sub-thermistor 34 will be described in a third exemplary embodiment.

After the temperature detected by the main thermistor 33 reaches the target temperature, a fixation processing is carried out in which the fixing nip portion N heats a recording material having an image formed thereon to fix the image onto the recording material while conveying the recording material.

(Decurling Device)

The decurling device 73 serving as a conveying unit includes a conveyance roller pair that forms a decurling nip portion (second nip portion) N3. The decurling nip portion N3 conveys a recording material to correct curling of the recording material. The conveyance roller pair includes a decurling roller 80 and an opposed decurling roller 81. The two rollers are brought into pressure contact with each other to form the decurling nip portion N3.

The decurling roller 80 (first roller) includes a core portion 80*a*, an elastic layer 80*b* which is provided on the outer peripheral surface of the core portion 80*a*, and a release layer 80*c* which is provided on the outer peripheral surface of the elastic layer 80*b*. In the present exemplary embodiment, a core metal which has a diameter of 10 mm and is made of iron is used as the core portion 80*a*, and foamed silicone rubber having an Asker C hardness of about 30 degrees is formed with a thickness of 2 mm on the elastic layer 80*b*. A PFA tube of 70 μm is coated as the release layer 80*c*.

The opposed decurling roller (second roller) 81 includes a core portion 81*a*, and a release layer 81*b* which is provided on the outer peripheral surface of the core portion 81*a*. In the present exemplary embodiment, a core metal which has a diameter of 9.5 mm and is made of iron is used as the core portion 81*a*, and a PFA tube of 100 μm is coated as the release layer 81*b*.

Thus, the decurling roller 80 coated with the elastic layer 80*b* having a low hardness is pressed by the opposed decurling roller 81 which includes no elastic layer and has a high hardness. The decurling nip portion N3 has a shape that is formed along the outer peripheral surface of the opposed decurling roller 81, and has a function of correcting curling of a recording material.

Further, in the present exemplary embodiment, the conveyance speed of the recording material passing through the decurling nip portion N3 is set to be higher than that of the recording material passing through the fixing nip portion N2. Accordingly, the conveyance of the recording material by the decurling nip portion N3 is more likely to have an influence on the fixing unit.

(Pressure Variable Mechanism)

Figure 4:
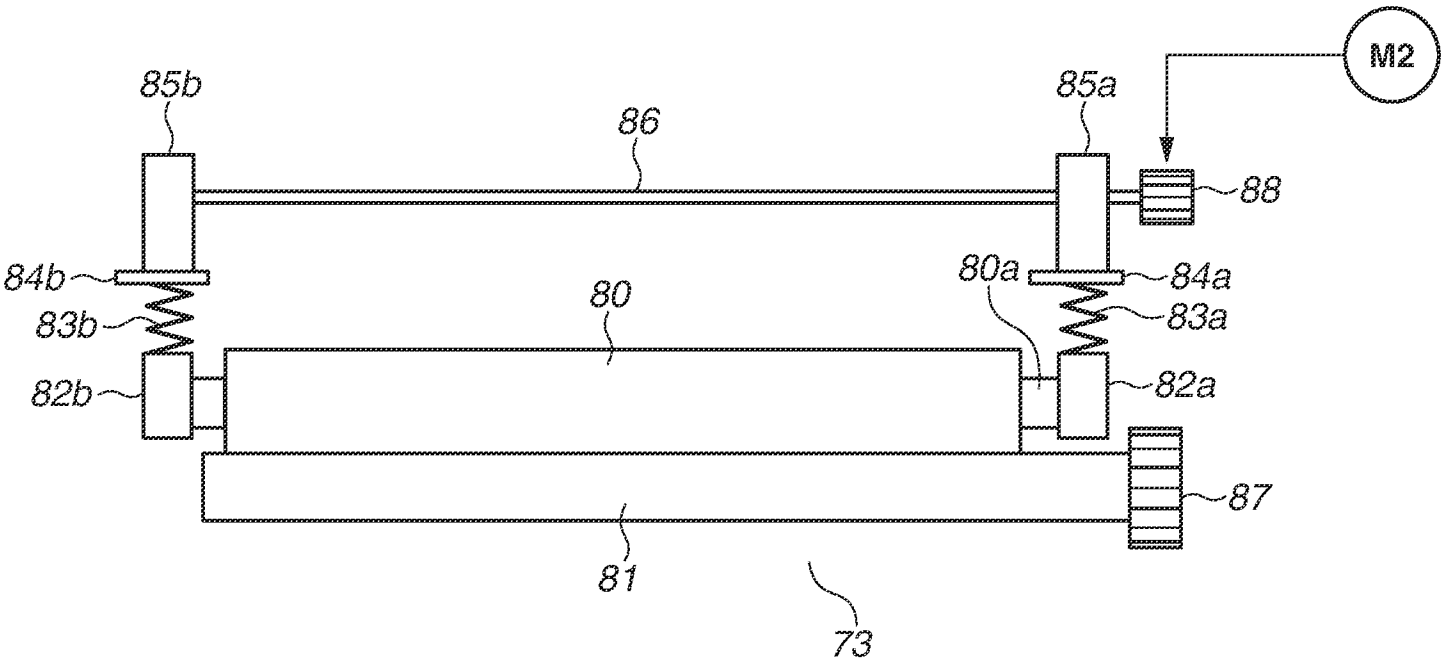
FIG. 4 is a front view illustrating a pressure variable mechanism of the decurling device according to the first exemplary embodiment.

FIG. 4 is a front view illustrating the decurling device including a pressure variable mechanism. The pressure variable mechanism of the decurling device 73 will be described with reference to FIG. 4.

The opposed decurling roller 81 is provided with a drive gear 87 and is supplied with a driving force from a motor (not illustrated). Flanges 82*a* and 82*b* are attached to both end portions of the core portion 80*a* of the decurling roller 80, and pressing springs 83*a* and 83*b* apply pressures to the flanges 82*a* and 82*b*, respectively. The inroad amounts of the pressing springs 83*a* and 83*b* are determined by pressure switching cams 85*a* and 85*b* across pressure sheet metals 84*a* and 84*b*, respectively, and the pressure of each of the pressing springs 83*a* and 83*b* is variable. The pressure switching cams 85*a* and 85*b* are each connected to a pressure switching gear 88 through a metal bar 86, and the pressure switching gear 88 is rotatable by a motor M2.

Figure 5:
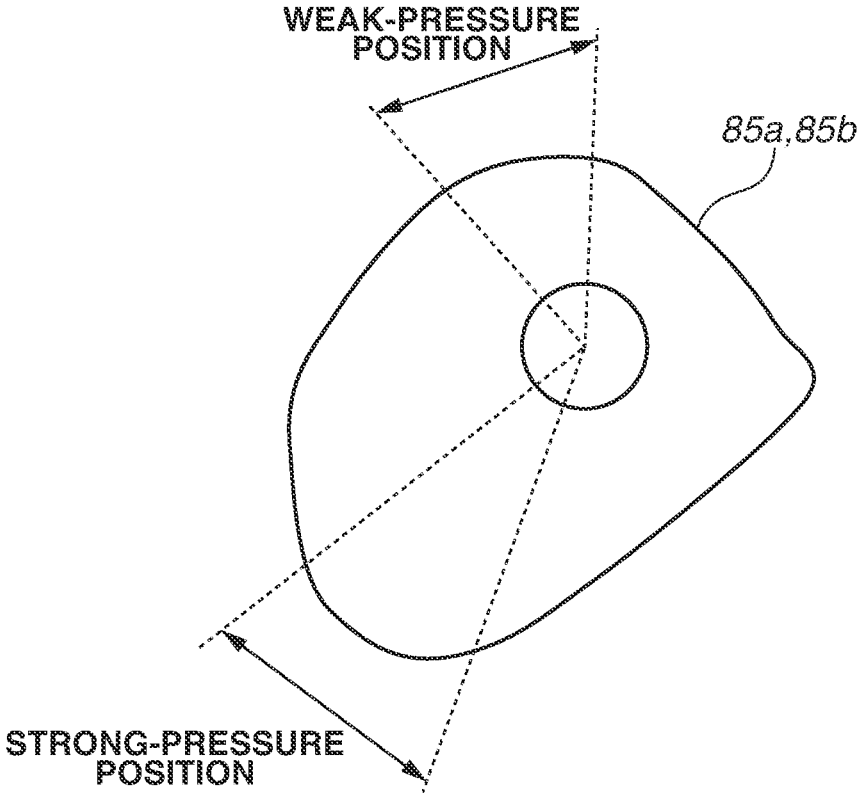
FIG. 5 is a diagram illustrating a shape of each cam of the pressure variable mechanism according to the first exemplary embodiment.

FIG. 5 illustrates the shape of the pressure switching cams 85*a* and 85*b* according to the present exemplary embodiment. The pressure switching cams 85*a* and 85*b* have an eccentric shape, and the inroad amounts of the pressing springs 83*a* and 83*b* can be changed by changing a stop position. In the present exemplary embodiment, the inroad amounts are set in such a manner that a pressure of kgf is applied to the decurling nip portion in a case where the pressure switching cams are set at a strong-pressure position where a strong pressure is applied as illustrated in FIG. 5, and a pressure of 1 kgf is applied to the decurling nip portion in a case where the pressure switching cams are set at a weak-pressure position where a weak pressure is applied. As described below, the control unit 700 controls the motor M2 to control the pressure variable mechanism as illustrated in FIG. 11.

As described above, the decurling device 73 can appropriately switch its pressure with the mechanism illustrated in FIG. 4.

(Detection of Recording Material Length)

Figure 11:
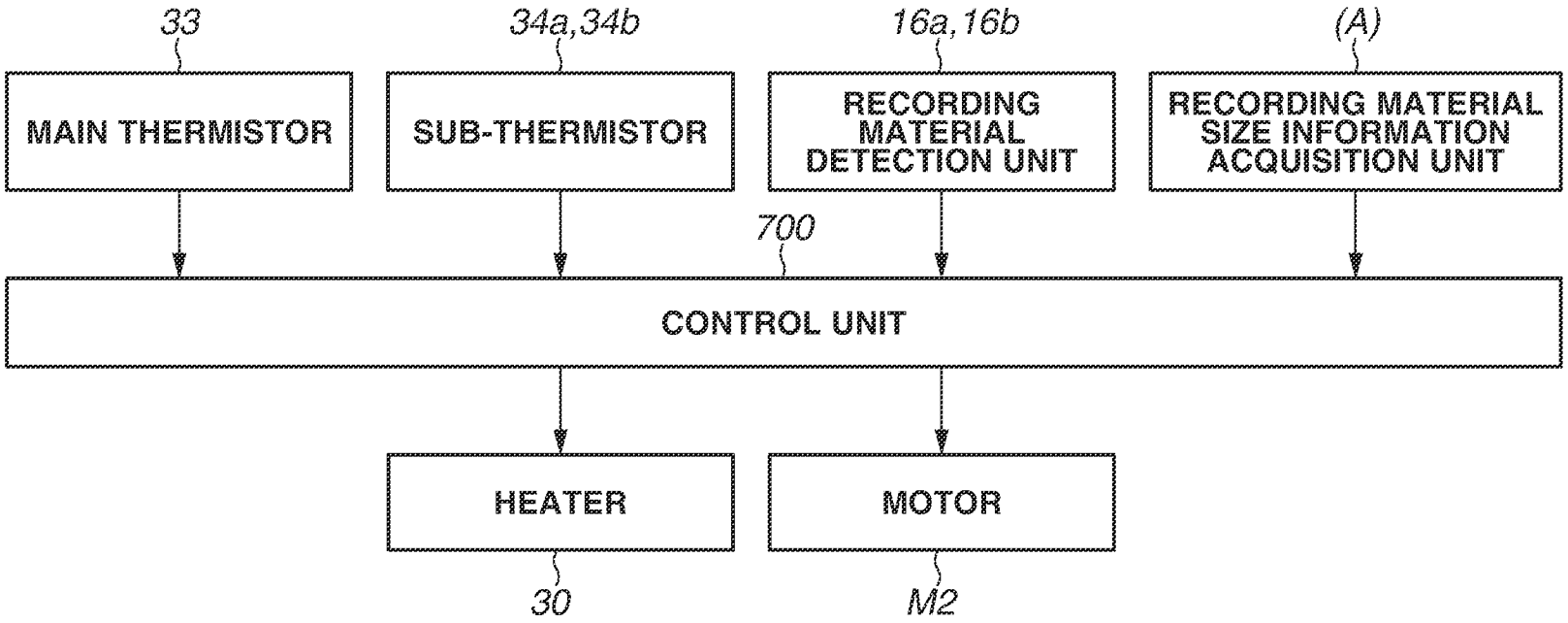
FIG. 11 is a control block diagram illustrating an image forming apparatus according to the first to third exemplary embodiments.

A recording material information acquisition unit (A) illustrated in FIG. 11 can acquire the length of a recording material in the conveying direction thereof from recording material information input during printing by a user, or image information provided in a controller. The length of the recording material in the conveying direction can also be obtained by reading detection results of various sensors attached within the image forming apparatus 71, or a value of a current flowing through each member. For example, information about the length of the recording material in the conveying direction can be acquired from the followings: a sensor provided in the multiple sheet supplying plate 51 or the sheet supplying cassette 61 (not illustrated), a recording material detection unit 16 installed between the registration rollers 15 and the secondary transfer nip portion N1, or a value of a transfer current flowing through the secondary transfer nip portion N1.

(Control for Pressure Variable Mechanism)

The pressure of the decurling nip portion N3 of the decurling device 73 is changed by the control unit 700 illustrated in FIGS. 1 and 11 which controls the motor M2 based on the result of detecting the length of the recording material. In the first exemplary embodiment, a length of 700 mm of the recording material P2 in the conveying direction is set as a threshold (predetermined length). When the length of the recording material P2 in the conveying direction is less than 700 mm, a strong-pressure setting (a first pressure) is set by giving priority to a correction of curling of the recording material. When the length of the recording material P2 in the conveying direction is equal to or greater than 700 mm, a weak-pressure setting (a second pressure lower than the first pressure) is set by giving priority to a reduction of damage to the fixing member. In the present exemplary embodiment, priority is given to the reduction of damage to the fixing member. Therefore, when the length of the recording material P2 in the conveying direction is equal to or greater than 700 mm, the weak-pressure setting is made regardless of grammage of the recording material or an environment where the image forming apparatus is installed.

The above-described threshold is preferably equal to or greater than the length of the recording material that is longest among the recording materials of fixed sizes preliminarily set in the image forming apparatus, or the recording materials of sizes that are described in a manual as available. In the present exemplary embodiment, since the size of the recording material having a length that is longest in the conveying direction among the recording materials of fixed sizes set in the printer 71 is SRA3 (320 mm×450 mm), 450 mm or longer is preferably set as the threshold. The above-described threshold may be changed as appropriate based on information about the environment where the image forming apparatus is placed (temperature-humidity information obtained by a temperature-humidity sensor), information about the grammage of a recording material, information about the length of a recording material in the width direction, information about a toner bearing amount, and the like. The fixed sizes preliminarily set in the image forming apparatus are, for example, fixed sizes preliminarily input on an operation unit (operation panel) of the image forming apparatus.

(Comparison of Performances)

Figure 6:
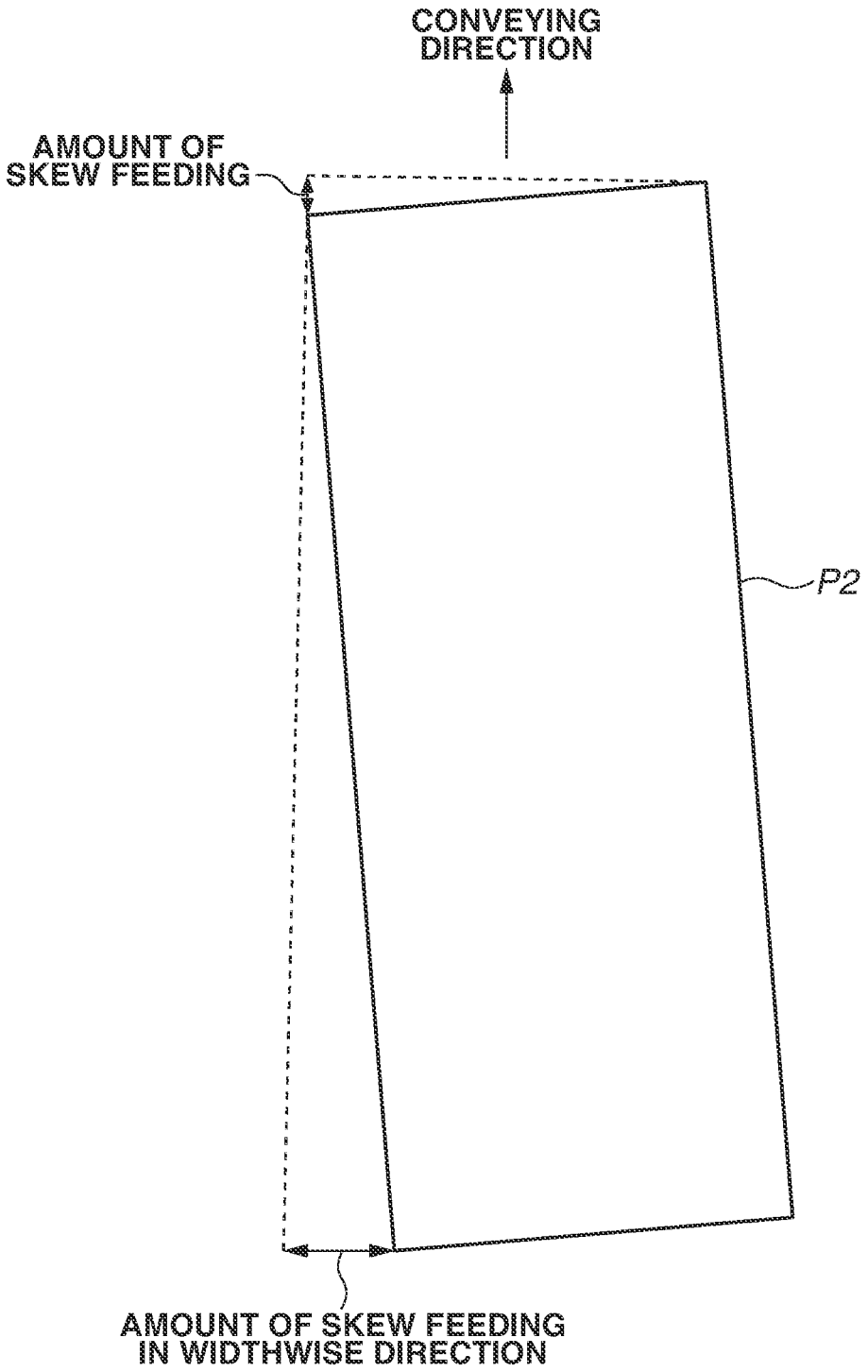
FIG. 6 is a diagram for defining an amount of skew feeding of a recording material according to the first exemplary embodiment.

Table 1 shows the results of confirming the effect of reducing damage to the fixing film 41 when the recording material P2 passes with a skew in the above-described configuration and under control of the pressure variable mechanism of the decurling device 73. An NPi-form continuous sheet (Canon Marketing Japan Inc.) having a size of 297 mm in a width direction and a size of 1200 mm in a conveying direction was cut in conveying direction lengths illustrated in Table 1 and used as a recording material. Further, the amount of skew feeding of the recording material P2 is defined as illustrated in FIG. 6. In the present exemplary embodiment, each recording material was caused to pass by adjusting the amount of skew feeding to 20 mm, regardless of the length of the recording material in the conveying direction. Thus, the surface of the fixing film 41 was visually observed, and every time each recording material P2 passed, it was checked whether damage such as creasing or cracking occurred on the fixing film 41. As Comparative Example 1, similar checking was performed also in a configuration for controlling the decurling device which makes a constant pressure regardless of information about the length of the recording material in the conveying direction.

Figure 7:
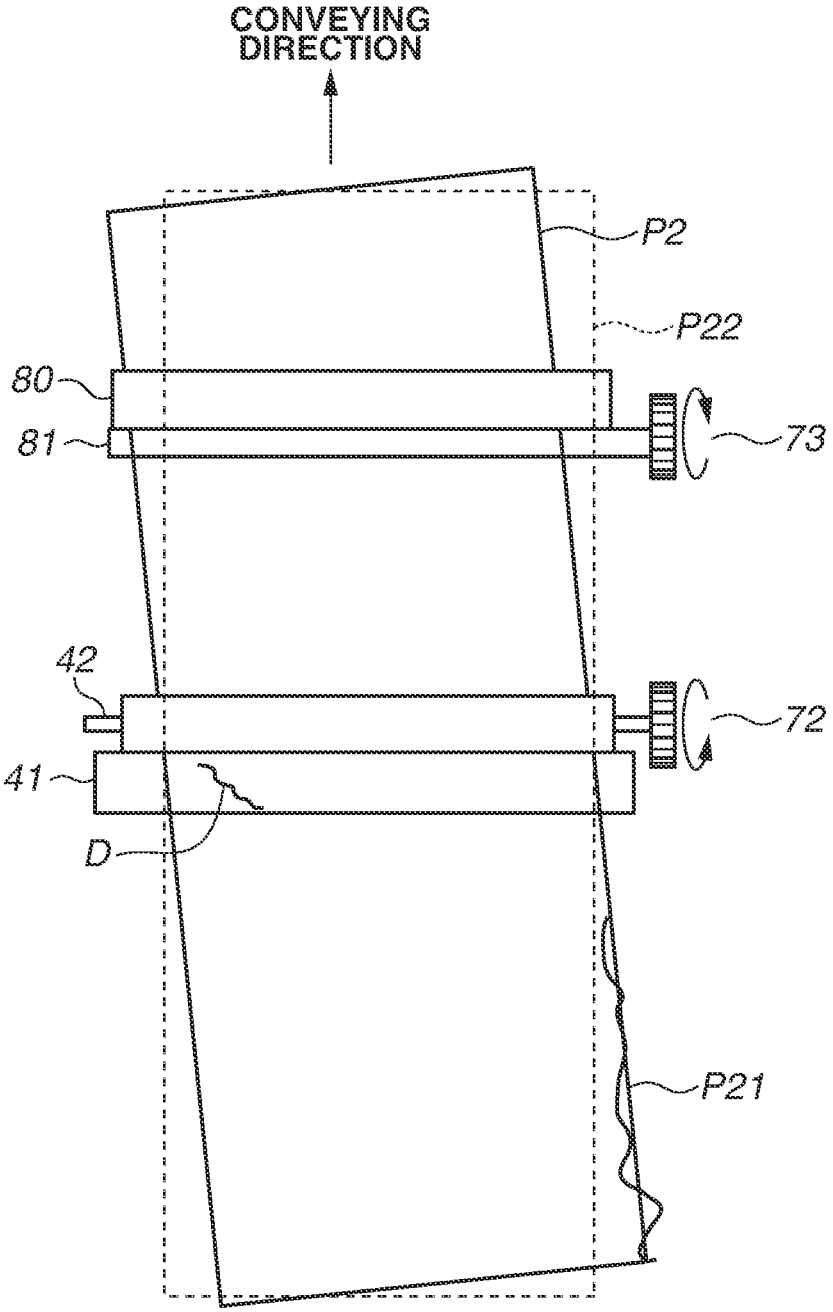
FIG. 7 is a front view illustrating the fixing device and the decurling device when a continuous sheet is skew-passed.

As a result of study in Table 1, in the configuration of Comparative Example 1, in the area in which the length of the recording material P2 in the conveying direction is equal to or greater than 800 mm, the fixing film creasing D occurred at a position illustrated in FIG. 7. When the recording material P2 indicated by a solid line in FIG. 7 is further conveyed, a sheet trailing edge portion P21 is regulated and deformed by the side regulating plate 52 and the like. Since the sheet trailing edge portion P21 is regulated, the sheet posture of the recording material P2 is induced to change to a posture P22 as indicated by a dashed line. At this time, the conveying direction of the recording material P2 is going to change in a state where the recording material is nipped by the nip portion between the fixing device 72 and the decurling device 73, so that a biasing force toward the fixing film is generated in the fixing nip portion N2. When the biasing force is larger than a predetermined value, the fixing film creasing D occurs. As shown in the study in Table 1, under a condition in which the amount of skew feeding is constant, the larger the amount of skew feeding in the width direction illustrated in FIG. 6, the larger the length of the recording material in the conveying direction. The larger the length of the regulated sheet trailing edge portion P21, the larger the amount of skew feeding in the width direction. Accordingly, the biasing force toward the fixing film 41 becomes larger. Therefore, in Comparative Example 1, the biasing force exceeded the predetermined value in the area in which the length of the recording material in the conveying direction is 800 mm or more, and the fixing film creasing D occurred.

On the other hand, in the first exemplary embodiment, a weak decurling pressure is set in the area in which the length of the recording material in the conveying direction is 700 mm or more, and the mode is switched to a mode in which priority is given to protection of the fixing member. When the decurling pressure is weak, the recording material P2 illustrated in FIG. 7 is more likely to shift to the posture P22 indicated by a dashed line. As a result, a regulating force of the sheet trailing edge portion P21 decreases, and the biasing force applied to the fixing film 41 decreases. Therefore, in the first exemplary embodiment, the fixing film creasing did not occur in the recording materials having any length in the conveying direction.

TABLE 2

| Amount of skew feeding 20 mm | | Length of recording material in conveying direction [mm] | | | | |
|---|---|---|---|---|---|---|
| | | 400 | 600 | 800 | 1000 | 1200 |
| First Comparative Example | Decurling pressure | Strong | Strong | Strong | Strong | Strong |
| | Sleeve creasing | ○ | ○ | x | x | x |
| First exemplary embodiment | Decurling pressure | Strong | Strong | Weak | Weak | Weak |
| | Sleeve creasing | ○ | ○ | ○ | ○ | ○ |

As described above, when the length of the recording material P2 in the conveying direction is longer than the predetermined length, the pressure of the decurling device 73 is set to the weak-pressure setting, so that the damage to the fixing member can be reduced during printing of a continuous sheet.

In the present exemplary embodiment, curling of the recording material on which the fixation process is performed is corrected by the conveying unit configured of the decurling roller 80 and the opposed decurling roller 81. However, the conveying unit is not limited to this embodiment. A conveying unit having a flat nip surface may also be used.

Further, in the present exemplary embodiment, the pressure variable mechanism is controlled based on the information about the length of the recording material acquired by the recording material information acquisition unit (A), but the method for controlling the pressure variable mechanism is not limited to this embodiment.

A user may selectively execute a mode (first mode) of forming an image on a recording material which is conveyed by the decurling nip portion N3 set to the first pressure and has a length less than a predetermined length, and a mode (second mode) of forming an image on a recording material which is conveyed by the decurling nip portion N3 set to the second pressure lower than the first pressure and has a length equal to or greater than the predetermined length.

A second exemplary embodiment will be described below. The configurations of an image forming apparatus, a fixing device, and a decurling device according to the second exemplary embodiment are similar to those of the first exemplary embodiment, and thus repeated descriptions thereof are omitted.

(Method for Detecting Skew-Feeding Amount of Recording Material)

In the second exemplary embodiment, the recording material detection unit 16 is used which is disposed between the registration rollers 15 and the secondary transfer unit N1. The recording material detection unit 16 is generally used for detecting the size of each recording material P2 in the width direction, but is also able to detect a skew feeding amount of the recording material P2 by a method described below.

Figure 8:
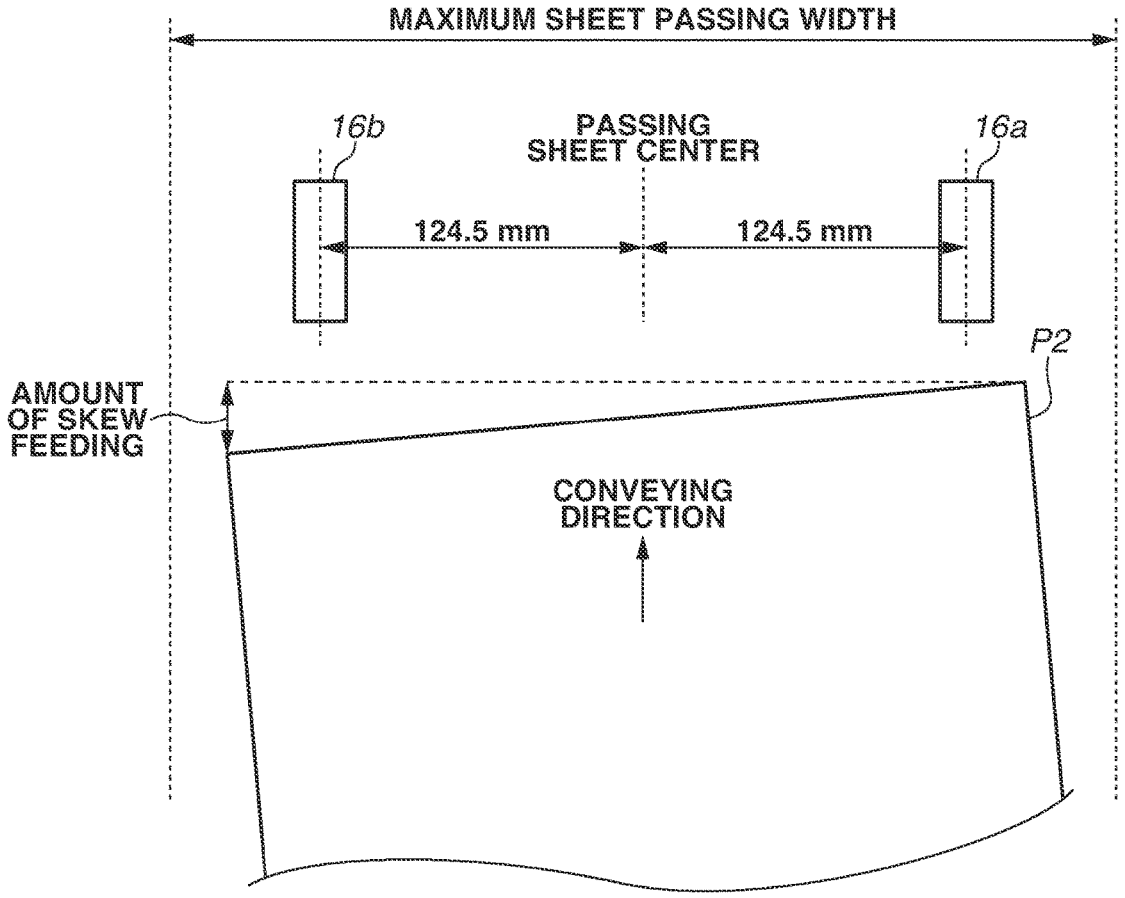
FIG. 8 illustrates a layout of a recording material detection unit according to a second exemplary embodiment.

FIG. 8 illustrates a layout of the recording material detection unit 16 in the width direction according to the second exemplary embodiment. As illustrated in FIG. 8, the recording material detection unit according to the present exemplary embodiment includes recording material detection units 16*a* and 16*b*. The recording material detection units 16*a* and 16*b* are disposed respectively at both end portions which are 124.5 mm from a sheet passing center position. When the recording material P2 is conveyed with a skewed posture illustrated in FIG. 8, the sheet leading edge of the recording material P2 first passes through the recording material detection unit 16*a*. Therefore, a difference of detection time occurs between the recording material detection units 16*a* and 16*b*. Based on the detection time difference, the amount of skew feeding of the recording material P2 can be obtained by the following formula (1).

$$\text{Amount of skew feeding} = (\text{conveyance speed of recording material } P2 \times \text{detection time difference between recording material detection units } 16a \text{ and } 16b) \times (\text{size of recording material } P2 \text{ in width direction/distance between recording material detection units } 16a \text{ and } 16b) \quad (1)$$

(Control for Pressure Variable Mechanism)

The pressure of the decurling device 73 is switched by setting a predetermined threshold (predetermined amount) to information about the amount of skew feeding obtained in the formula (1). In the second exemplary embodiment, an amount of skew feeding of 12.5 mm is set as the threshold. When the amount of skew feeding is less than 12.5 mm, priority is given to correction of curling of the recording material and the strong-pressure setting is made. When the amount of skew feeding is equal to or greater than 12.5 mm, priority is given to the reducing of damage to the fixing member and the setting is changed to the weak-pressure setting. The second exemplary embodiment is more advantageous than the first exemplary embodiment in that when the amount of skew feeding is small, curling can be corrected even if the length of the recording material P2 in the conveying direction is long.

(Comparison of Performances)

Table 2 shows results of confirming an effect of reducing damage to the fixing film 41 when the recording material P2 passes with a skew in the above-described configuration and under control of the pressure variable mechanism of the decurling device 73.

The NPi-form continuous sheet which is the same as that in the first exemplary embodiment is used as a recording material without being cut. As shown in Table 2, each recording material P2 is caused to pass with the amount of skew feeding of the recording material P2 which is set at intervals of 5 mm. The surface of the fixing film 41 was visually observed, and every time each recording material P2 passed, it was checked whether damage such as creasing or cracking occurred on the fixing film 41. As Comparative Example 2, similar checking was performed also in a configuration for controlling the decurling device which makes a constant pressure regardless of information about an amount of skew feeding of the recording material.

As a result of study in Table 2, in the configuration of Comparative Example 2, in the area in which the amount of skew feeding of the recording material P2 is equal to or greater than 15 mm, fixing film creasing occurred at a position similar to that illustrated in FIG. 7 of the first exemplary embodiment. By the mechanism that is the same as the mechanism of the first exemplary embodiment, the larger the biasing force toward the fixing film 41, the larger the amount of skew feeding. Therefore, in Comparative Example 2, in the area in which the amount of skew feeding is equal to or greater than 15 mm, the biasing force exceeded a predetermined value and fixing film creasing occurred.

On the other hand, in the second exemplary embodiment in which the decurling pressure is switched to the weak-pressure setting in the area in which the amount of skew feeding is 12.5 mm or more, the biasing force applied to the fixing film 41 decreases. Therefore, the fixing film creasing did not occur in the recording materials having any size in the conveying direction in the second exemplary embodiment.

TABLE 2

| Amount of skew feeding 1200 mm | | Amount of skew feeding [mm] 0 | 5 | 10 | 15 | 20 |
|---|---|---|---|---|---|---|
| Second Comparative Example | Decurling pressure | Strong | Strong | Strong | Strong | Strong |
| | Sleeve creasing | ○ | ○ | ○ | x | x |
| Second exemplary embodiment | Decurling pressure | Strong | Strong | Strong | Strong → Weak | Strong → Weak |
| | Sleeve creasing | ○ | ○ | ○ | ○ | ○ |

As described above, when a skew detection unit detects an amount of skew that is larger than a predetermined size, damage to the fixing member during printing of a continuous sheet can be reduced by changing the pressure of the decurling device 73 to the weak-pressure setting.

In the second exemplary embodiment, the control unit 700 illustrated in FIG. 11 calculates the amount of skew feeding of each recording material based on a signal from the recording material detection unit 16, and controls the pressure variable mechanism according to the calculated amount of skew feeding.

A third exemplary embodiment will be described below. The configurations of an image forming apparatus, a fixing device, and a decurling device according to the third exemplary embodiment are similar to those of the first exemplary embodiment and thus repeated descriptions thereof are omitted.

(Method for Detecting Amount of Skew Feeding of Recording Material)

In the third exemplary embodiment, a method for detecting an amount of skew feeding of each recording material P2 by using the sub-thermistor 34 will be described. When the amount of skew feeding is detected using the recording material detection unit 16 as described in the second exemplary embodiment, the amount of skew feeding may fluctuate in the secondary transfer nip portion N1 and the like. Therefore, there is a possibility that the amount of skew feeding cannot be accurately recognized at a time when the recording material reaches the fixing device 72. However, in the third exemplary embodiment, the amount of skew feeding is detected at the position of the fixing device 72, which leads to an increase in the detection accuracy of the amount of skew feeding as compared with the method of the second exemplary embodiment. A method for controlling the decurling device 73 after the amount of the skew feeding of the recording material P2 is detected, and advantages effects obtained in the third exemplary embodiment are similar to those of the second exemplary embodiment, and thus descriptions thereof are omitted.

Figure 9:
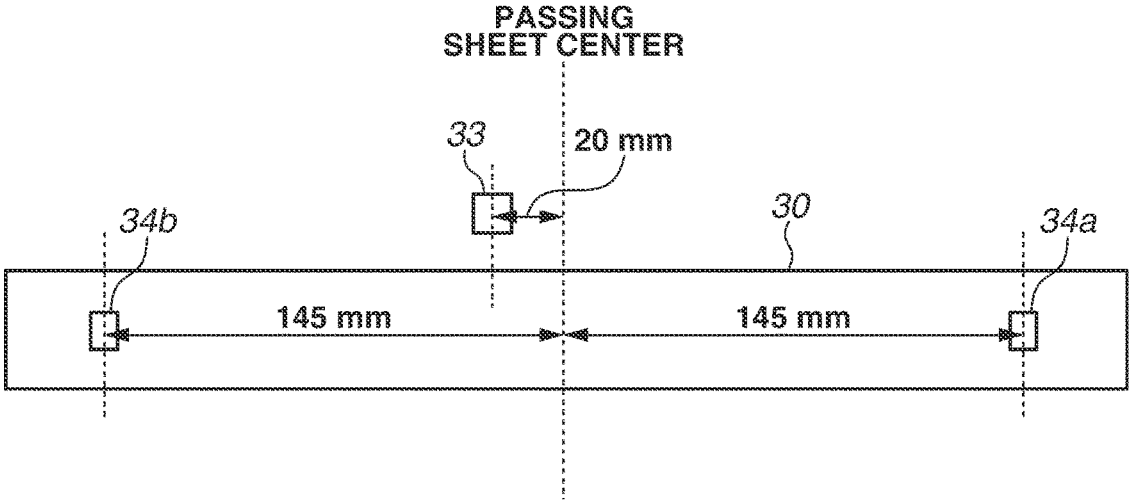
FIG. 9 illustrates a layout of a temperature detection element according to a third exemplary embodiment.
Figure 10:
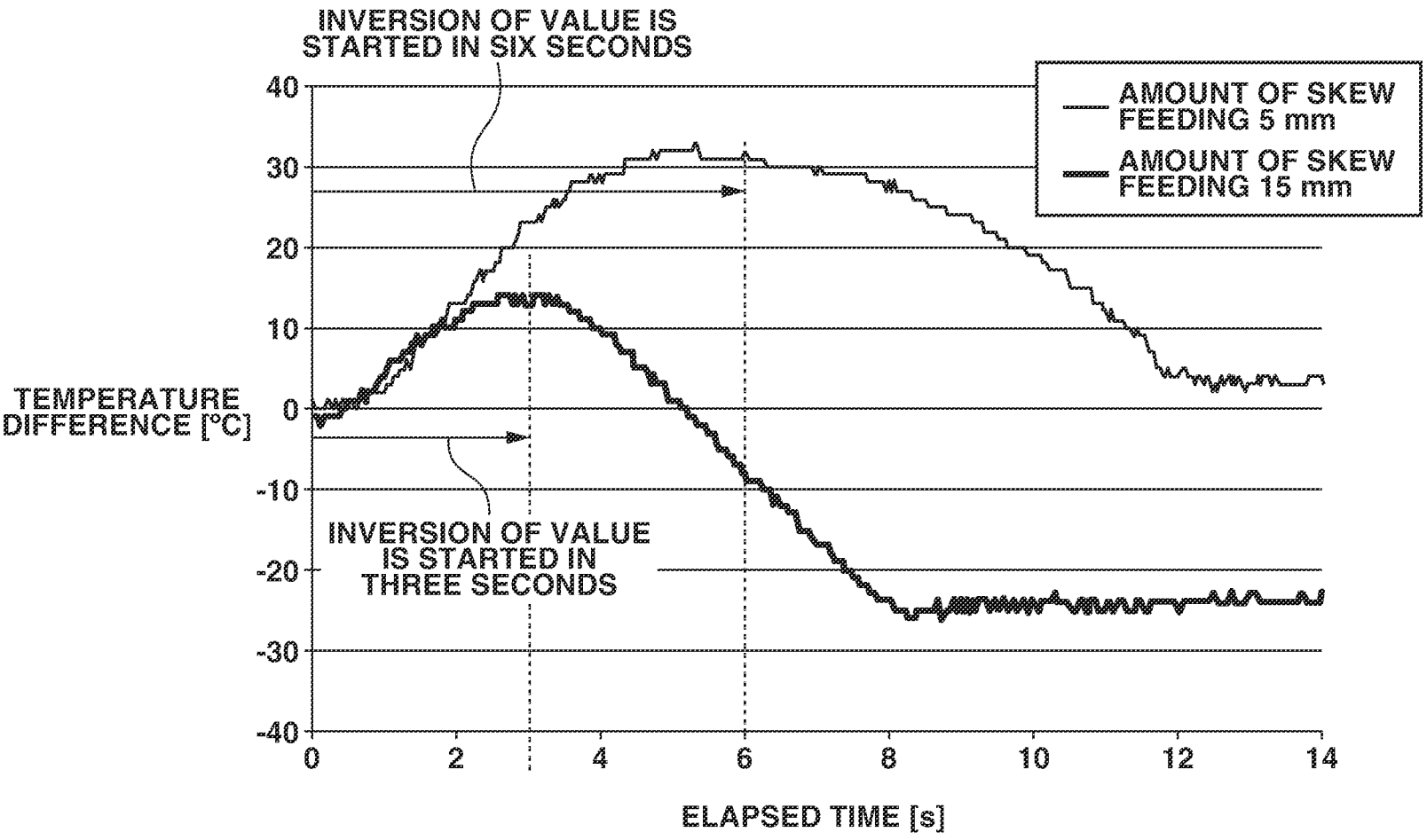
FIG. 10 is a graph illustrating an example of a skew detection result obtained by the temperature detection element according to the third exemplary embodiment.

FIG. 9 illustrates a layout of the main thermistor 33 and the sub-thermistor 34 in the width direction of each recording material. The main thermistor 33 is disposed at a location that is 20 mm from the center so that a sheet passing area can be ensured even when a recording material having a minimum available width passes the main thermistor 33. Sub-thermistors 34*a* and 34*b* are disposed at both sides that are 145 mm from the center. The amount of skew feeding of the recording material P2 can be detected by monitoring a temperature difference between the sub-thermistors 34*a* and 34*b* (hereinafter referred to simply as a temperature difference). FIG. 10 is a graph in which a temperature difference is plotted with time between a temperature obtained when the recording material P2 (the NPi-form continuous sheet which is the same as that used in the second exemplary embodiment) is caused to pass with an amount of skew feeding of 5 mm, and a temperature obtained when the recording material P2 is caused to pass with an amount of skew feeding of 15 mm. If a recording material is caused to pass in a skew-fed state, the temperature difference is inverted in a minus direction after the temperature difference increases in a plus direction. If the skew direction of the recording material is reverse, the temperature difference is inverted in the plus direction at a certain time after the temperature difference increases in the minus direction. An inversion start time of the temperature difference tends to decrease as the amount of skew feeding increases. As illustrated in FIG. 10, when the amount of skew feeding is 5 mm, the inversion is started in about six seconds. However, when the amount of skew feeding is 15 mm, the inversion is started in about three seconds. The relationship between the inversion start time and the amount of skew feeding is represented by an empirical formula such as Formula (2) in the case of the fixing device according to the present exemplary embodiment. By using the formula (2), the amount of skew feeding of the recording material P2 can be obtained from a detection result of a thermistor temperature difference.

$$\text{amount of skew feeding[mm]} = 24 - 3 \times \text{inversion start time[seconds]} \quad (2)$$

In the third exemplary embodiment, the control unit 700 illustrated in FIG. 11 controls the pressure variable mechanism by driving the motor M2 according to the difference between the detected temperatures of the sub-thermistors 34*a* and 34*b*.

The first to third exemplary embodiments describe a case where the pressure of the decurling device is switched in two steps of a weak pressure and a strong pressure. However, also in a configuration in which the pressure is switched in three or more steps, or a configuration capable of continuously changing the applied pressure, the advantageous effects of the present exemplary embodiment can be obtained. While the present exemplary embodiment illustrates a case where one decurling device is provided, two or more decurling devices may be mounted to correct each recording material in a direction opposite to that in the present exemplary embodiment. In this case, the advantageous effects of the present exemplary embodiments can be obtained by decreasing the applied pressure of at least one of the decurling devices.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-237117, filed Dec. 6, 2016, which is hereby incorporated by reference herein in its entirety.

What is claimed is:

1. An image forming apparatus comprising:

an image forming unit configured to form an image on a recording material;

a fixing unit configured to fix the image on the recording material, the fixing unit including a tubular film and an opposed member which is in contact with an outside surface of the film to form a first nip portion together with the film, wherein the recording material having the image formed thereon is heated while being conveyed by the first nip portion;

a conveying unit configured to convey the recording material having the image fixed thereon by the fixing unit, the conveying unit including a second nip portion configured to convey the recording material, the second nip portion being located at a position where a piece of recording material can be conveyed by the first nip portion and the second nip portion simultaneously;

a pressure variable mechanism capable of changing a pressure of the second nip portion;

a control unit configured to control the pressure variable mechanism; and an acquisition unit configured to acquire information about a length of the recording material in a conveying direction of the recording material, wherein the control unit controls the pressure variable mechanism according to the information about the length of the recording material acquired by the acquisition unit so that the recording material is conveyed by the second nip portion set to a first pressure in a case where the length of the recording material is less than a predetermined length, and the recording material is conveyed by the second nip portion set to a second pressure lower than the first pressure in a case where the length of the recording material is equal to or greater than the predetermined length.

2. The image forming apparatus according to claim 1, wherein the predetermined length is equal to or greater than the length of the recording material that is longest in the conveying direction of the recording material, among recording materials of fixed sizes preliminarily set in the apparatus.

3. The image forming apparatus according to claim 1, wherein a conveyance speed of the recording material passing through the second nip portion is higher than a conveyance speed of the recording material passing through the first nip portion.

4. The image forming apparatus according to claim 1, wherein in a case where the length of the recording material is equal to or greater than the predetermined length, the recording material is conveyed by the second nip portion set to the second pressure, regardless of an environment in which the image forming apparatus is installed.

5. The image forming apparatus according to claim 1, wherein in a case where the length of the recording material is equal to or greater than the predetermined length, the recording material is conveyed by the second nip portion set to the second pressure, regardless of grammage of the recording material.

6. The image forming apparatus according to claim 1, wherein the conveying unit includes a first roller and a second roller having a surface with a hardness greater than the hardness of a surface of the first roller, the second roller being in contact with the first roller to form the second nip portion.

7. The image forming apparatus according to claim 1, wherein the fixing unit includes a heater being in contact with an inside surface of the film, and the heater forms the first nip portion through the film.

8. An image forming apparatus comprising:

an image forming unit configured to form an image on a recording material;

a fixing unit configured to fix the image on the recording material, the fixing unit including a tubular film and an opposed member which is in contact with an outside surface of the film to form a first nip portion together with the film, wherein the recording material having the image formed thereon is heated while being conveyed by the first nip portion;

a conveying unit configured to convey the recording material having the image fixed thereon by the fixing unit, the conveying unit including a second nip portion configured to convey the recording material, the second nip portion being located at a position where a piece of recording material can be conveyed by the first nip portion and the second nip portion simultaneously;

a pressure variable mechanism capable of changing a pressure of the second nip portion; and a control unit configured to control the pressure variable mechanism, wherein the control unit can execute a first mode in which the control unit controls the pressure variable mechanism in such a manner that a pressure of the second nip portion becomes a first pressure and the second nip portion set to the first pressure conveys the recording material, and a second mode in which the control unit controls the pressure variable mechanism in such a manner that the pressure of the second nip portion becomes a second pressure lower than the first pressure, and the second nip portion set to the second pressure conveys the recording material, and wherein the first mode is a mode in which an image is formed on the recording material having a length less than a predetermined length, and the second mode is a mode in which an image is formed on the recording material having a length equal to or greater than the predetermined length.

9. The image forming apparatus according to claim 8, wherein the predetermined length is equal to or greater than the length of the recording material that is longest in the conveying direction of the recording material, among recording materials of fixed sizes preliminarily set to the image forming apparatus.

10. The image forming apparatus according to claim 8, wherein a conveyance speed of the recording material passing through the second nip portion is higher than a conveyance speed of the recording material passing through the first nip portion.

11. The image forming apparatus according to claim 8, wherein when the length of the recording material is equal to or greater than the predetermined length, the recording material is conveyed by the second nip portion set to the second pressure regardless of an environment in which the image forming apparatus is installed.

12. The image forming apparatus according to claim 8, wherein when the length of the recording material is equal to or greater than the predetermined length, the recording material is conveyed by the second nip portion set to the second pressure regardless of grammage of the recording material.

13. The image forming apparatus according to claim 8, wherein the conveying unit includes a first roller and a second roller including a surface with a hardness greater than the hardness of a surface of the first roller, the second roller being in contact with the first roller to form the second nip portion.

14. The image forming apparatus according to claim 8, wherein the fixing unit includes a heater being in contact with an inside surface of the film, and the heater and the roller form the first nip portion across the film.

* * * * *